US005531646A

United States Patent [19]

Boyle

[11] Patent Number: 5,531,646

[45] Date of Patent: Jul. 2, 1996

[54] ROCKABLE BILLIARD BALL RACK AND METHOD OF RACKING BALLS

[76] Inventor: Patrick Boyle, 2248 Forest Glen Dr., Warrington, Pa. 18976

[21] Appl. No.: 494,419

[22] Filed: Jun. 26, 1995

[51] Int. Cl.[6] ..... A63D 7/00

[52] U.S. Cl. ..... 473/40

[58] Field of Search ..... 473/40; 294/32

[56] References Cited

U.S. PATENT DOCUMENTS

| | | | |
|---|---|---|---|
| 850,360 | 4/1907 | Flint | 473/40 |
| 1,115,911 | 11/1914 | Dickinson | 473/40 |
| 1,246,436 | 11/1917 | Kitzman | 473/40 |
| 3,844,460 | 10/1974 | Courtright | 294/32 |
| 3,898,297 | 2/1990 | Wheeler | 294/32 |

*Primary Examiner*—Theatrice Brown
*Attorney, Agent, or Firm*—Eric A. LaMorte

[57] ABSTRACT

A rack assembly for use in racking billiard balls on a billiards table. The rack assembly has a racking frame made of rail elements that define a periphery of a given shape into which the pool balls are to be arranged. The bottom edge of each of the rails terminates in a common plane. As such, the racking frame is capable of laying flush on the flat surface of the pool table. A rotator handle is coupled to the racking frame. The rotator handle is a rocker element having a first end, a second end and a curved surface disposed between the first end and the second end. The first end of the rocker element is joined to the racking frame. The curved surface of the rocker element intersects the plane shared by the bottom of the racking frame at a tangent. As a result, when a generally downward force is applied to the second end of the rocker element, the rocker element rocks in one direction along the curved surface. As the curved surface rolls along the surface of the pool table, the first end of the rocker element is move upwardly, thereby lifting the racking frame off of the pool table in a manner that does not disturb the pool balls contained within the racking frame.

12 Claims, 6 Drawing Sheets

ROCKABLE BILLIARD BALL RACK AND METHOD OF RACKING BALLS

REFERENCE TO DISCLOSURE DOCUMENT

The invention set forth in this application was the subject of Document Disclosure No. 367544 which was filled in the Patent and Trademark Office on Dec. 23, 1994.

BACKGROUND OF THE INVENTION

1. Field of the Invention

The present invention relates in general to billiard ball racks used to orient billiard balls or pool balls at the beginning of a game of billiards or pool. More particularly, the present invention relates to billiard ball racks that include a mechanism that assists in the removal of the rack from the collection of balls, after the balls have been arranged in a desired orientation by the rack.

2. Prior Art Statement

There are many different types of games that can be played that fall generally under the category of "pool" or "billiards". In many of these games, the balls used in the game are positioned in a predetermined orientation at the beginning of the game. For example, in the version of pool commonly called eight-ball, fifteen pool balls are arranged in a triangular pattern with the eight-ball in the center of the triangle. In the version of pool commonly called nine-ball, nine balls are arranged in a diamond pattern with the nine-ball in the center. Traditionally, the balls are positioned in a desired orientation by the use of a rack. The rack is shaped to surround the periphery of the balls and cause them to lay in a desired orientation. As a result, when the proper number of balls are placed in the rack, the balls automatically conform to the shape of the rack. Once the desired sequence of balls in the rack is achieved, a player moves the rack to the proper position on the playing table and removes the rack. Assuming the playing table is not sloped, the balls remain in the shape of the rack until the balls are stuck by another ball during play.

The area defined by a rack is slightly larger than the area of the balls in the rack when properly oriented. The reason of the slight oversizing is to enable the balls to be easily placed into the rack and to promote the easy removal of the rack without disrupting the newly arranged balls. In billiards and pool it is desirable for the balls in a rack to be tightly packed so that all balls are in abutment when the rack is removed. As a result, a person placing the balls in a rack, typically pushes the balls into a closely packed arrangement just prior to removing the rack from around the balls. The problem with this traditional racking method is that as the balls are pushed against each other they are also pushed against at least one of the inside surfaces of the rack. Accordingly, some of the balls are in abutment with the rack as the rack is removed. Since some of the balls abut against the rack, it becomes very difficult to remove the rack without causing movement in the balls and adversely effecting the closely packed arrangement of the balls.

In the past there have been several devices invented that were intended to help a person rack pool balls or billiard balls. However, these prior art racks did little to help a remove the rack from a tightly packed arrangement of balls. Such prior art is exemplified by U.S. Pat. No. : 501,256 to Rohrbach, entitled TRIANGLE FOR BILLIARD BALLS, and U.S. Pat. No. : 1,089,140 to Madigan, entitled POOL OR OTHER GAME FRAME. In both of these references, the rack helps a person to form a tightly packed arrangement of balls, but no means is provided for the easy removal of the racks from around the tightly packed arrangement of balls.

Some racks were invented that contained features that provided assistance in removing the rack from around tightly packed balls. These racks typically included knobs or handles that helped a person grab hold of the rack. See for instance U.S. Pat. No. : 1,887,552 to Gunn, entitled SPOTTING RACK FOR POOL BALLS and U.S. Pat. No. : 1,260,540, to Hogue entitled, POOL BALL RACK AND BASKET. Although such racks help a person to engage and manipulate the rack, the effective removal of the rack from the tightly packed balls is still dependent upon the hand/eye coordination of the person moving the rack.

It is therefore an object of the present invention to provide a billiard ball rack that has a mechanism thereon the assists a person in removing the rack from around a tightly packed arrangement of balls in a manner that is not dependent entirely upon hand/eye coordination skills.

It is a further object of the present invention to provide an improved method or racking billiard balls and removing the rack from the newly arranged balls.

BRIEF DESCRIPTION OF THE DRAWINGS

For a better understanding of the present invention, reference is made to the following description of exemplary embodiments thereof, considered in conjunction with the accompanying drawings, in which.

SUMMARY OF THE INVENTION

The present invention is a rack assembly for use in racking billiard balls on a billiards table. The rack has a racking frame made of rail elements that define a periphery of a given shape into which the pool balls are to be arranged. The bottom edge of each of the rails that comprise the racking frame terminates in a common plane. As such, the racking frame is capable of laying flush on the flat surface of the pool table. A rotator handle is coupled to the racking frame. The rotator handle is a rocker element having a first end, a second end and a curved surface disposed between the first end and the second end. The first end of the rocker element is joined to the racking frame. The curved surface of the rocker element intersects the plane of the pool table at a tangent. As a result, when a generally downward force is applied to the second end of the rocker element, the rocker element rocks in one direction along the curved surface. As the curved surface rolls along the surface of the pool table, the first end of the rocker element is move upwardly. Since the first end of the rocker element is coupled to the racking frame, the racking frame is lifted off of the pool table in a manner that does not disturb the pool balls contained within the racking frame.

DETAILED DESCRIPTION OF THE PRESENT INVENTION

Although the present invention can be used with any sized or shaped pool ball rack or billiard ball rack, the present invention is particularly adapted for use with racks having acute angles such as triangular racks and diamond shaped racks. As a result, the present invention will be described in conjunction with a tradition triangular eight-ball rack and a traditional diamond shaped nine-ball rack in order to set forth the best modes contemplated for the invention.

Figure 1:
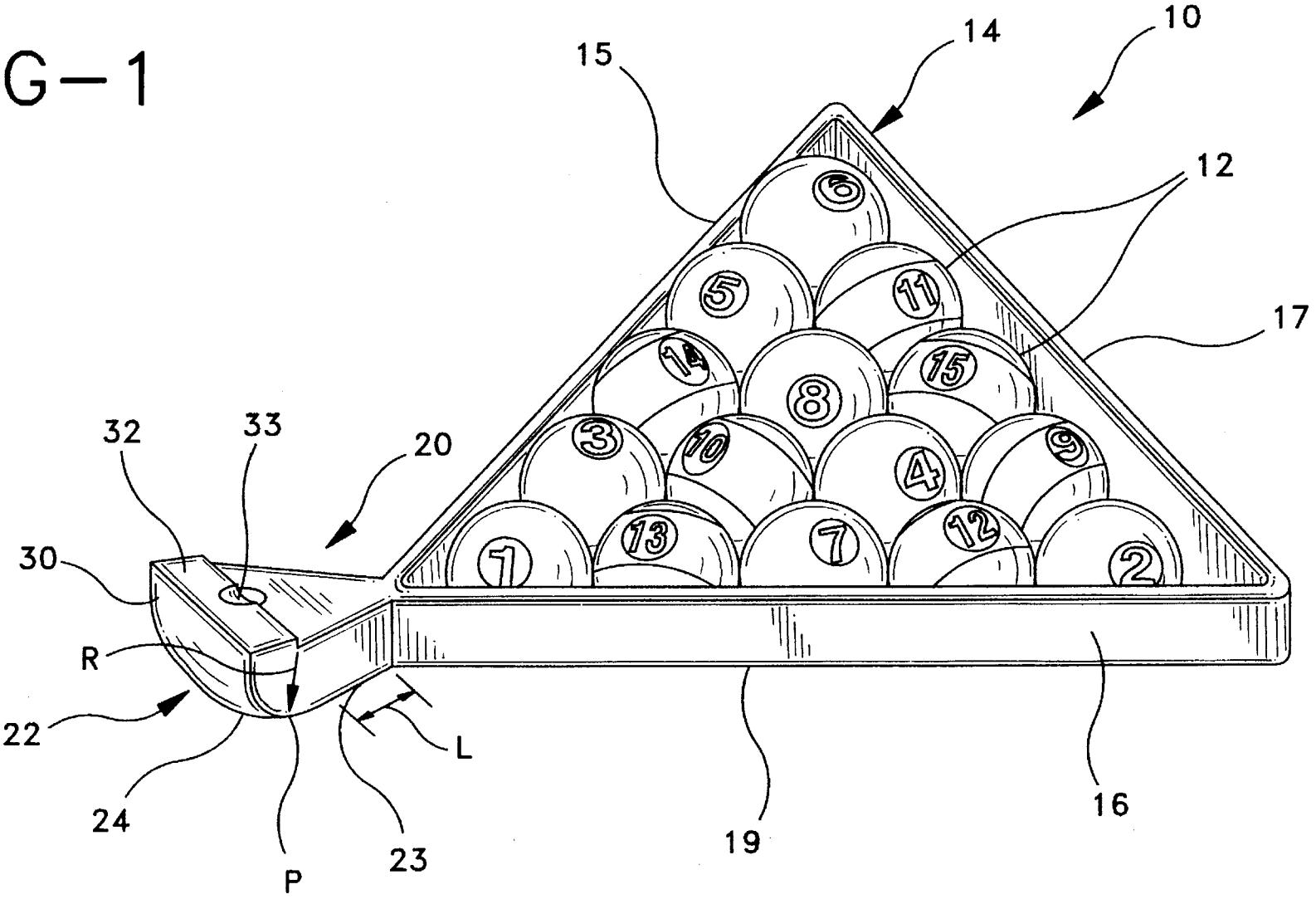
FIG. 1 is a perspective view of one preferred embodiment of the present invention rack shown in conjunction with fifteen pool balls to promote further consideration and discussion.

Referring to FIG. 1, the present invention rack 10 is shown in conjunction with fifteen pool balls 12. The rack 10 has a triangular racking frame 14 comprised of three equally sized rails 15, 16, 17. The bottom edges 19 of each of the rails 15, 16, 17 terminates in a common plane, thereby enabling the triangular racking frame 14 to sit flush on any flat surface. The triangular racking frame 14 is shaped and sized to be the same as traditional triangular pool racks, wherein the rack is capable or orienting the pool balls 12 in a triangular pattern and five of the fifteen pool balls 12 abut against each of the three rails 15, 16, 17.

A rotator handle 20 extends from one of the apexes between two adjacent side rails. The bottom surface 22 of the rotator handle 20 lays flush within the same plane 19 as the bottom edges 19 of each of the three side rails 15, 16, 17. Consequently, when placed on a flat surface such as a pool table, all three side rails 15, 16, 17 and the bottom surface 22 of the rotator handle 20 will touch the below lying surface. The bottom surface 22 of the rotator handle 20 has a straight flat section 23 that extends along a predetermined length L ranging from 0 cm to 10 cm. In the preferred embodiment, the predetermined length L is between 2 cm and 5 cm. At point P, the bottom surface 22 changes from the flat section 23 to a curved section 24. In the shown embodiment, the curved section 24 has a constant radius R that causes the bottom surface 22 of the rotator handle 20 to curve up and away from the surface on which the rack 10 rests. Although a constant radius curvature is shown, it should be understood that a curvature of a varying radius or a compound curvature having segments of differing radius could also be used.

The curved section 24 of the rotator handle 20 leads into a vertical section 30 that terminates at a flat contact surface 32. A finger notch 33 is disposed within the contact surface 32 to facilitate a person physically applying a downward force to the contact surface 32 with a finger. The rotator handle 20 is rigidly coupled to the triangular racking frame 14 of the rack 10. The triangle racking frame 14 of the rack 10 and the rotator handle are rigid structures and can be made from any traditional material such as metal, wood or plastic. If made from plastic, the rotator handle 20 and the triangle racking frame can be unistructurally molded as a single unit. In the preferred embodiment, the rack 10 is made of wood. As such the rotator handle 20 is permanently joined to the triangular racking frame 14 using glue, nails, screws or any other common wood-to-wood fastening technique.

Figure 2:
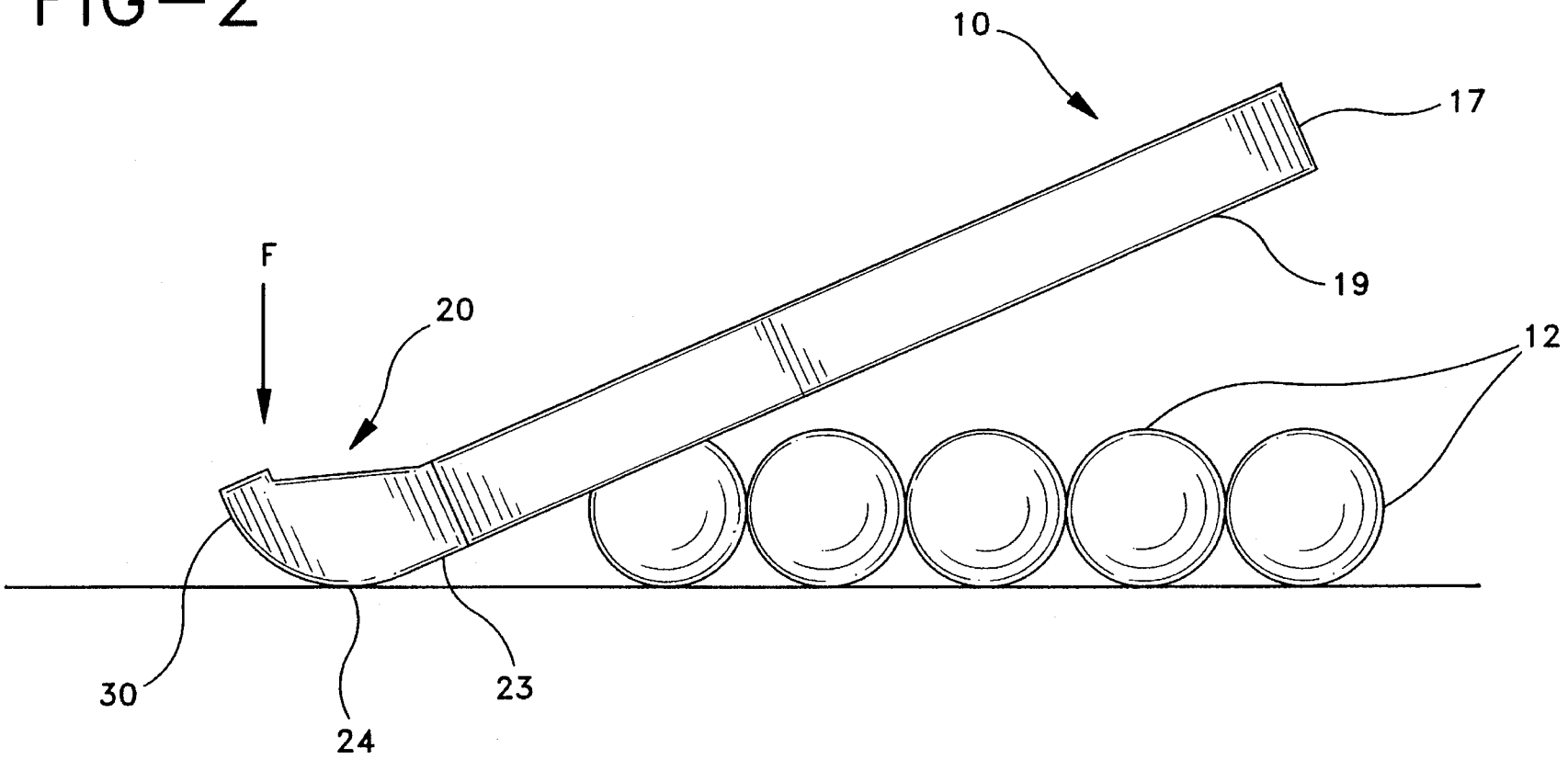
FIG. 2 shows a side view the embodiment of FIG. 1 shown in a rotated position, thereby illustrating the operation of the present invention rack.

During operation, the rack 10 is positioned at the appropriate place on the pool table. The fifteen pool balls 12 are the placed within the triangular racking frame 14 of the rack 12 in the desired sequence. The pool balls 12 are then pushed tightly together in a triangular pack by pushing the balls 12 away from the rear side rail 17. This causes the balls to abut against each other and to abut against the side rails 15, 16 that meet at the rotator handle 20. Once the pool balls 12 are tightly packed, a downward force F is manually applied to the contact surface 32 of the rotator handle with a person's hand or finger. Referring to FIG. 2, it can be seen that the application of the downward force F causes the curved section 24 of the rotator handle to act as a rocker element, whereby the downward force F causes the rotator handle 20 to rotate around the curved section 24. The rotational movement causes the flat section 23 of the rotator handle 20 to raise off of the pool table. Since the rotator handle 20 is rigidly attached to the triangular racking frame of the rack 10, the racking frame 14 raises off of the pool table. The downward force F is applied to the rotator handle 20 until the vertical section 30 of the rotator handle touches the pool table and stops the rotation. When the vertical section 30 of the rotator handle 20 touches the pool table, the rear side rail 17 is above the level of the pool balls 12. As a result, the rear side rail 17 can be easily grasped and the rack removed from around the tightly packed pool balls 12.

Figure 3:
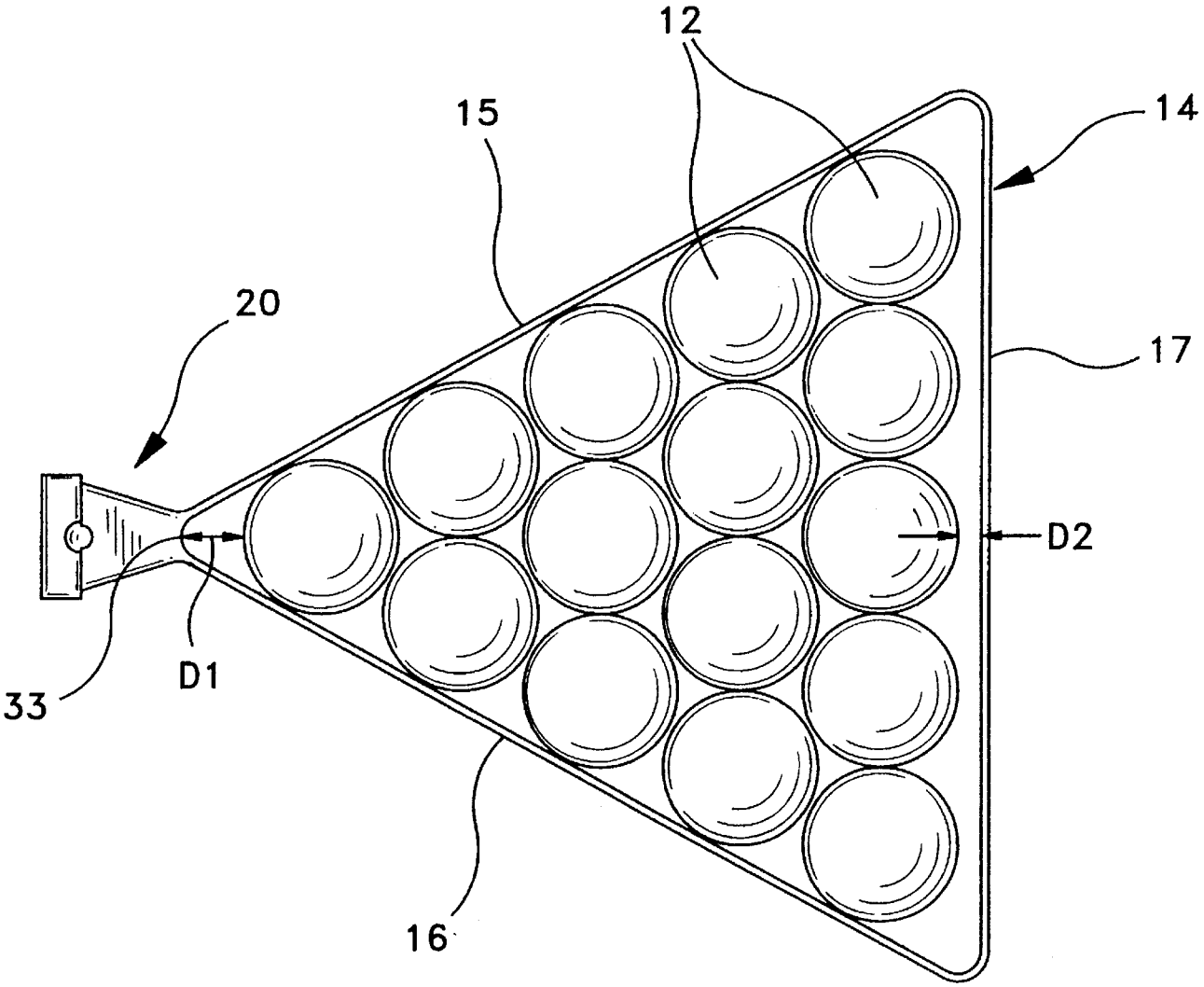
FIG. 3 shows a top view of the embodiment of FIG. 1.

Referring to FIG. 3 in conjunction with FIG. 2. It can be seen that as the downward force F (FIG. 2) is applied to the rotator handle 20, the side rails 15, 16 in contact with the pool balls 12 rotate remain in a vertical plane as they raise off of the pool table. Since the side rails 15, 16 remain in a vertical plane there is no force created by the movement of the rails 15, 16 that acts to disrupt the pool balls 12 from their tightly packed orientation. Consequently, as the rack 10 is removed the pool balls are not disrupted.

As the triangular racking frame 14 of the rack 10 rotates off of the pool table, the rear side rail 17 and the line of intersection between the two side rails 15, 16 at the apex 33 do not remain in vertical planes. Rather the rear side rail 17 moves along a curved path in toward the pool balls as does the bottom of the apex 33. The triangular racking frame 14 of the rack 10 should be sized so that the distance D1 (FIG. 3) between the apex 33 and the pool balls 12 as well as the distance D2 (FIG. 3) between the rear side rail 17 and the pool balls 12 are both sufficient to avoid contacting the balls 12 when the rack 10 is being removed.

Figure 4:
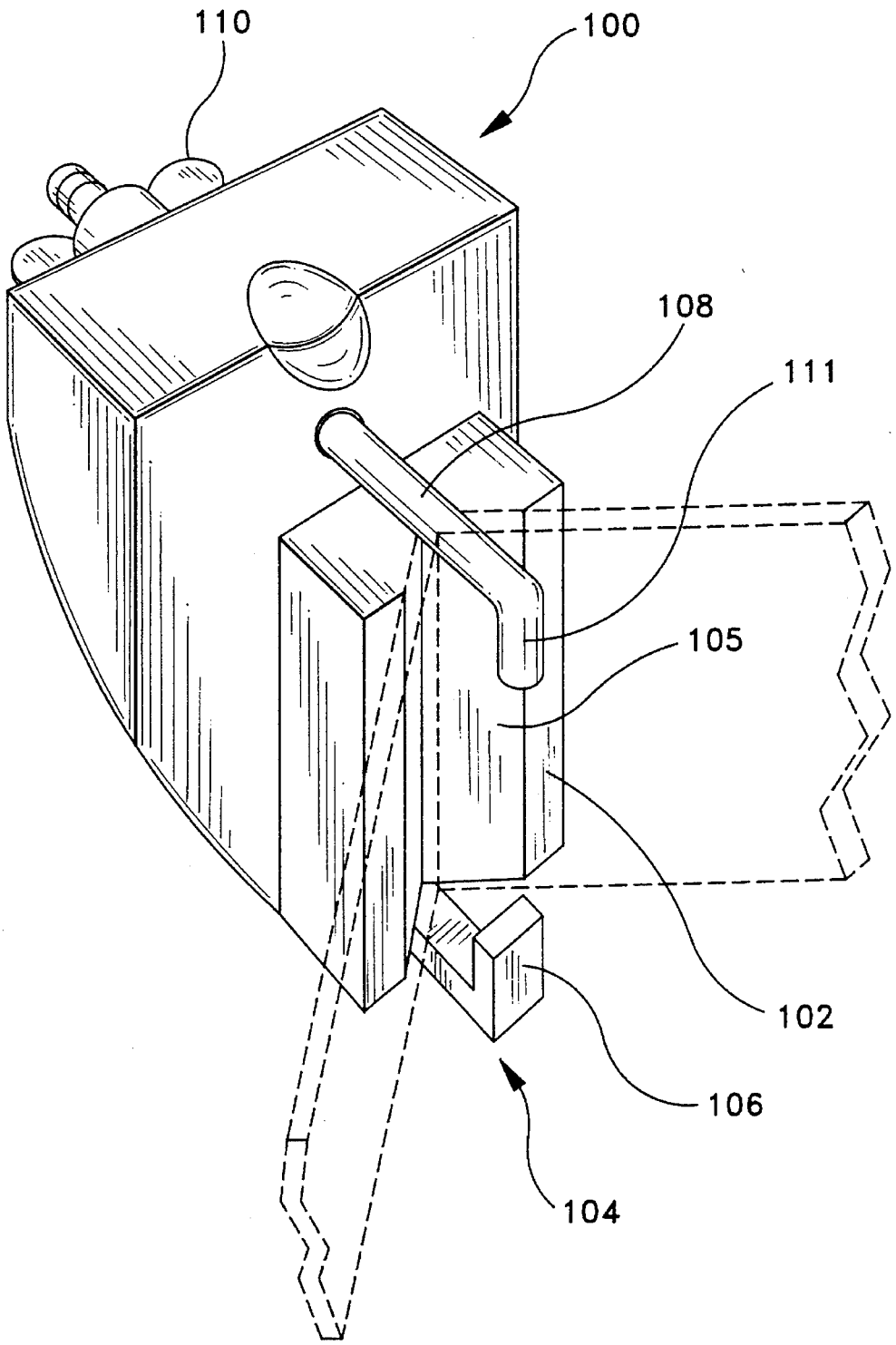
FIG. 4 shows an alternate embodiment of the rotator handle assembly portion of the present invention that can be retroactively added to an existing rack to produce an assembly such as is shown in FIG. 1.

Referring to FIG. 4 a variation of the present invention is shown. Most people who own pool tables or billiard tables already own one or more racks used to arrange balls upon those tables. FIG. 4 shows a rotator handle assembly 100 that can be retroactively added to an existing pool ball rack. The rotator handle assembly 100 operates in the same manner as was previously described and has essentially the same parts as were previously described. The main difference of this embodiment is that the rotator handle assembly 100 is manufactured and sold as a separate unit. The rotator handle assembly 100 is then retroactively coupled to an existing pool rack to product the novel device shown an described in FIGS. 1, 2 and 3.

In the shown embodiment, the rotator handle assembly 100 has a notched face surface 102. The notch 105 in the face surface is adapted to abut against the apex point of a traditional triangular rack or diamond shaped rack (shown in hidden lines). An anchored hook structure 104 extends from the bottom of the face surface 102. The head 106 of the hook structure 104 is disposed a predetermined distance from the face surface 102 to enable the hook structure 104 to engage the apex of a rack from one side while the opposite side of the rack apex is in abutment with the notch 105. An adjustable hook structure 108 is coupled to the rotator handle assembly 100 at a point above the notch 105. The length of the adjustable hook structure 108 can be selectively varied by the tightening and loosening of the wing nut 110. The head 111 of the adjustable hook structure 108 is hooked over the top edge of the rack apex. The wing nut 110 is then tightened until the adjustable hook structure 108 biases the rack into the notch 105. As a result, the rotator handle assembly 100 has been retroactively joined to a common rack producing a new novel rack as has been explained.

It should be understood that there are many different clamping structures, mechanical fasteners and adhesive fasteners that can be used to either permanently or temporarily join the rotator handle assembly 100 to a rack. Any such attachment means is intended to be included in the scope of this description.

Figure 5:
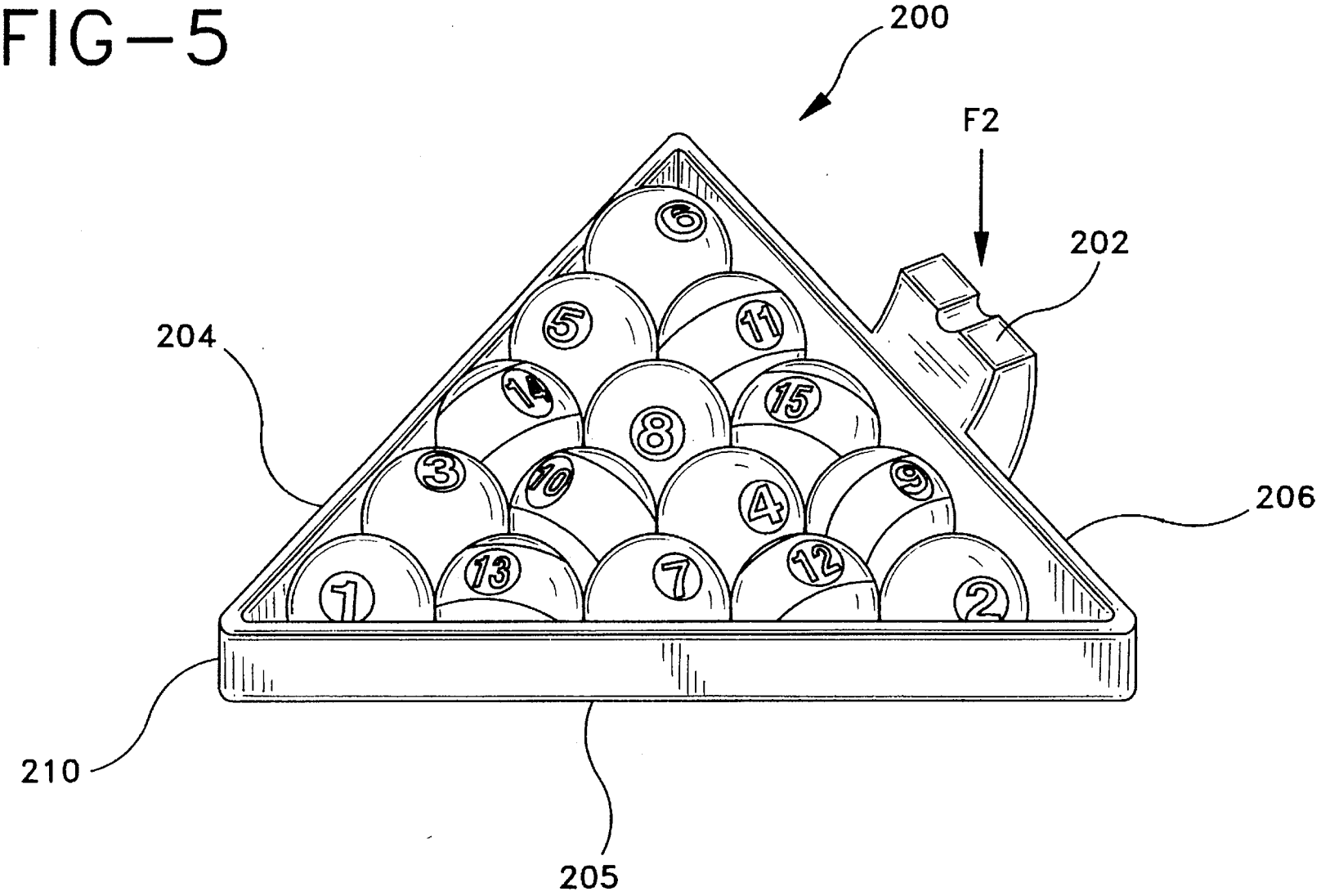
FIG. 5 shows an alternate embodiment of the present invention rack.

In FIG. 5. an alternate embodiment of the present invention rack 200 is shown wherein the rotator handle 202 is attached to the center of one of the rail elements 204, 205, 206 that form the ball rack. With the rotator handle 202 in such a position, it will be understood the when a downward force F2 is allied to the rotator handle 202 the front apex 210 will raise into the air. In this embodiment, the balls must be oriented in the rack 200 and then the rack 200 must be pushed slightly forward so that the balls are not touching any of the three rail elements 204, 205, 206. Once the balls are not in abutment with any of the rails, the downward force F2 is applied to the rotator handle 202. The front apex 210 then raises and the rack 200 is removed. Although this is the exact opposite of what happens in the embodiment of FIG. 1, the method of removing the rack assembly 200 is essentially the same. Furthermore, provided the rails do not abut against the rack when removed, the ability of the rack assembly 200 to be removed without disturbing a grouping of tightly packed balls is greatly increased over prior art racks. When playing pool, often the rear rail 206 is at a point on the pool table that is more readily reached than is the front apex 210. Accordingly, by placing the rotator handle 202 at such a position, the overall rack assembly 200 may be more readily used.

Figure 6:
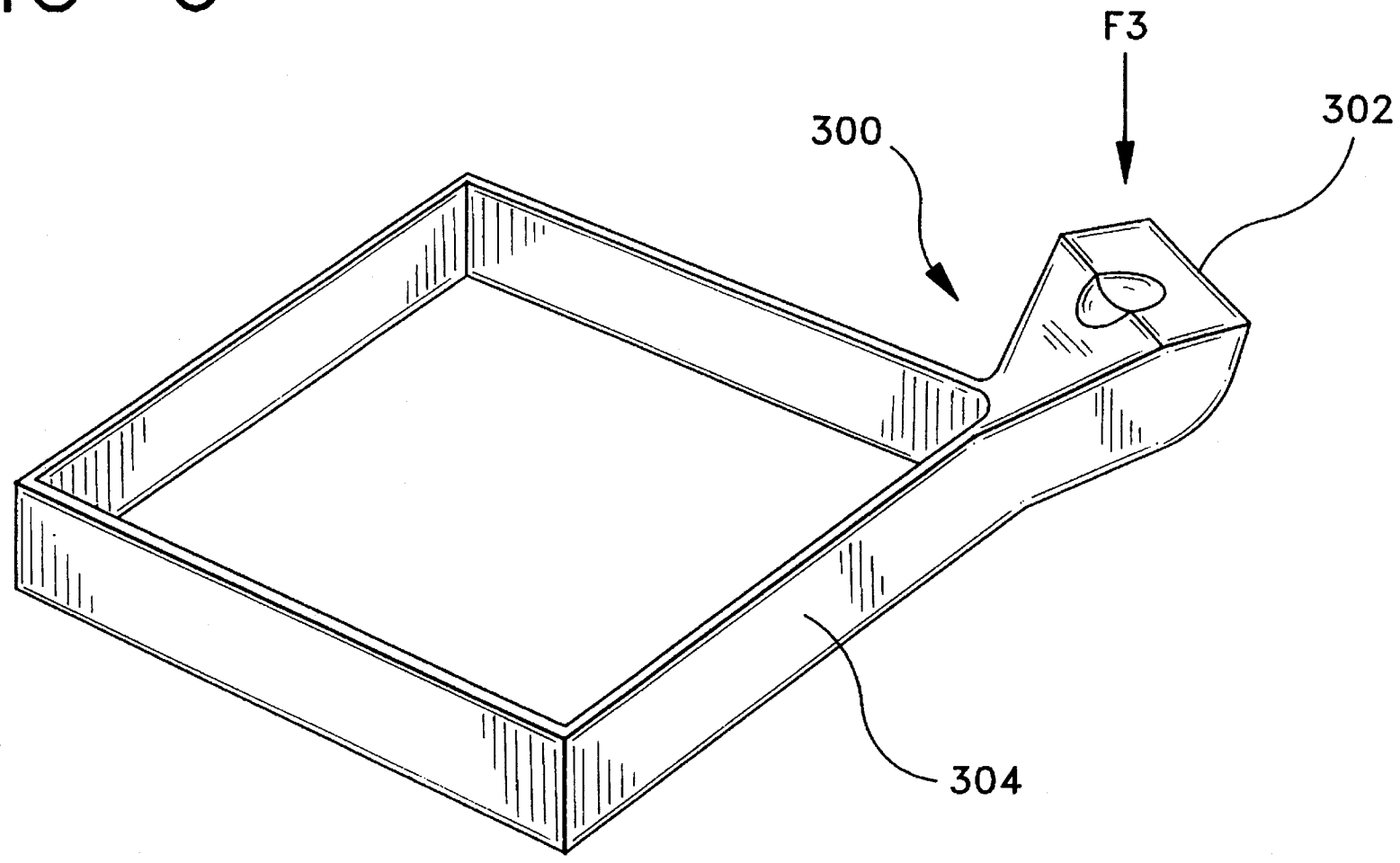
FIG. 6 shows another alternate embodiment of the present invention rack configured for use in the game of nine-ball.

Referring lastly to FIG. 6 yet another embodiment of the present invention rack assembly 300 is shown, wherein a rotator handle 302 is affixed to a diamond shaped nine-ball framing rack 304. In such an embodiment, the rotator handle 302 can be joined to any of the four apex points in the framing rack 304. Accordingly, by placing a downward force F3 on the rotator handle, the opposite apex point would rise off of the pool table and allow the rack assembly 300 to be removed without disturbing the balls that were packed by the rack.

It will be understood that the embodiments of the present invention rack and rotator handle assembly illustrated and described above are merely exemplary and many variations and modifications can be made by using functionally equivalent components and/or alternate embodiments. For instance, it will be understood by a person skilled in the art that a large variety of curved surfaces that do not have constant radii could be used as part of the rotator handle to raise the rack off of the pool table. All such variations and modifications are intended to be included within the scope of the invention as defined by the appended claims.

What is claimed is:

1. A rack assembly for arranging balls on a flat surface, comprising:

a plurality of rail elements joined together to form a racking frame having an open bottom and an open top, wherein each of said rail elements has a bottom edge that terminates in a common bottom plane capable of laying flush on the flat surface;

a handle coupled to at least one of said rail elements, said handle having a contact surface and a curved section wherein said curved section intersects said bottom plane at a tangent, whereby a predetermined force applied to said contact surface causes said curved section to rock on the flat surface and raises said racking frame above the flat surface.

2. The rack assembly according to claim 1, wherein at least two of said rail elements join at a common point on said racking frame, and said handle is coupled to said racking frame at said common point.

3. The rack according to claim 1, wherein said handle is coupled to the center of one of said rail elements.

4. A rack assembly for racking a plurality of pool balls on a pool table, comprising:

a racking frame having a plurality of straight rails joined together to define an enclosed region with an open bottom surface that terminates in a common plane, thereby enabling a surface of each of said rails to lay flush on said pool table;

a rocker element having a first end, a second end and a rocker section disposed between said first end and said second end, wherein said first end is coupled to said racking frame and said rocker section contacts the pool table when the racking frame is laying flush on the pool table, whereby a predetermined force applied generally downwardly to said second end causes said rocker element to move about said rocker section and raise said bottom surface of said racking frame off of the pool table.

5. The rack assembly according to claim 4, wherein said rocker section is curved.

6. The rack assembly according to claim 4, wherein two of said rails within said racking frame are joined at a common point and said rocker element is coupled to said common point.

7. The rack according to claim 4, wherein said rocker element is coupled to the center of one of said rails.

8. The rack according to claim 4, wherein a finger groove is disposed on said second end of said rocker element.

9. A rotator handle assembly for use with a pool ball rack comprised of a plurality of straight rails that are joined to together to form the periphery of a predetermined geometric shape, wherein the pool ball rack is used for racking pool balls in said predetermined geometric shape on a pool table, said rotator handle assembly comprising:

a handle body having a first end, an opposite second end and a curved surface disposed between said first end and said second end; and a connecting means disposed at said first end for connecting said handle body to at least one of the rails of the pool ball rack wherein said curved surface of said handle body contacts the pool table when the pool ball rack is racking pool balls on the pool table.

10. The rotator handle assembly according to claim 9, wherein said connecting means includes a clamp for mechanically engaging at least one of the rails of the pool ball rack.

11. A method racking pool balls on a pool table comprising the steps of:

providing a racking frame having a racking region for retaining a plurality of balls in a predetermined orientation on the pool table, and at least one rocker element extending from said racking region, wherein said rocker element includes a curved section;

placing said racking frame on said pool table, wherein said curved section of said rocker element abuts against said pool table;

placing a plurality of pool balls in said racking frame, wherein said pool balls conform to said predetermined orientation;

applying a downward force to said rocker element causing said racking frame to rotate about said curved section of said rocker element until at least one portion of said racking frame raises above said plurality of pool balls; and engaging the portion of said racking frame raised above said plurality of pool balls and removing said racking frame completely from around said plurality of pool balls.

12. The method according to claim 11, further including the step of tightly packing said plurality of pool balls in said racking frame before said racking frame is removed.

* * * * *